US006608014B1

(12) United States Patent
Schramm, Jr. et al.

(10) Patent No.: US 6,608,014 B1
(45) Date of Patent: Aug. 19, 2003

(54) UNIT DOSE NONAQUEOUS SOFTENER DISPOSED IN WATER SOLUBLE CONTAINER

(75) Inventors: Charles Schramm, Jr., Hillsborough, NJ (US); Arthur Wagner, Roselle Park, NJ (US); Marianne Zappone, Burlington, NJ (US); Amjad Farooq, Hillsborough, NJ (US); Jeffrey T. Epp, Arlington, NJ (US); Joseph Reul, Heusy (BE); Hoai-Chau Cao, Ans (BE); Alain Jacques, Blegny (BE); Alain Gourgue, Lincent (BE); Juliette Rousselet, Glons (BE)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 10/287,400

(22) Filed: Nov. 4, 2002

Related U.S. Application Data

(63) Continuation-in-part of application No. 10/209,580, filed on Jul. 31, 2002, now Pat. No. 6,495,504.

(51) Int. Cl.[7] ..... C11D 17/00

(52) U.S. Cl. ..... 510/296; 510/297; 510/327; 510/329; 510/330; 510/334; 510/391; 510/439; 510/501; 510/515; 510/499

(58) Field of Search ..... 510/216, 297, 510/327, 329, 330, 334, 391, 439, 499, 501, 515

(56) References Cited

U.S. PATENT DOCUMENTS

| | | | | | |
|---|---|---|---|---|---|
| 4,203,851 | A | * | 5/1980 | Ramachandran | 252/8.6 |
| 4,259,217 | A | * | 3/1981 | Murphy | 252/547 |
| 4,569,773 | A | | 2/1986 | Ramachandran et al. | 252/8.7 |
| 4,605,506 | A | | 8/1986 | Wixon | 252/8.75 |
| 4,818,412 | A | | 4/1989 | Boris et al. | 252/8.8 |
| 4,818,421 | A | * | 4/1989 | Boris et al. | 252/8.8 |
| 4,851,138 | A | | 7/1989 | Jaroschek et al. | 252/88 |
| 5,089,148 | A | * | 2/1992 | Van Blarcom et al. | 252/8.6 |
| 5,183,580 | A | * | 2/1993 | Lew et al. | 252/8.6 |
| 5,225,100 | A | | 7/1993 | Fry et al. | 252/174.25 |
| 5,425,887 | A | * | 6/1995 | Lam et al. | 252/8.6 |
| 5,770,557 | A | * | 6/1998 | Bruhnke | 510/515 |
| 5,972,870 | A | * | 10/1999 | Anderson | 510/298 |

* cited by examiner

*Primary Examiner*—Necholus Ogden
(74) *Attorney, Agent, or Firm*—Richard E. Nanfeldt

(57) ABSTRACT

A water soluble container having disposed therein a non-aqueous liquid fabric softener composition.

14 Claims, No Drawings

UNIT DOSE NONAQUEOUS SOFTENER DISPOSED IN WATER SOLUBLE CONTAINER

RELATED APPLICATION

This application is a continuation in part application of U.S. Ser. No. 10/209,580 filed Jul. 31,2002 now U.S. Pat. No. 6,495,504.

FIELD OF THE INVENTION

This invention relates to unit dose laundry compositions for softening or conditioning fabrics. More particularly, this invention relates to unit dose fabric softening compositions, which are contained in a water-soluble container suitable for use in an automatic washing machine, wherein these compositions effectively deliver fragrance to the fabric as well as antistatic benefits and fabric softening.

BACKGROUND OF THE INVENTION

Detergent compositions manufactured in the form of compacted detergent powder are known in the art. U.S. Pat. No. 5,225,100, for example, describes a tablet of compacted powder comprising an anionic detergent compound, which will adequately disperse in the wash water.

Although detergent compositions in the form of compacted granular tablets of various shapes have received much attention in the patent literature, the use of such tablets to provide a unit dose fabric softener which will soften or condition fabrics in the wash cycle without impairing detergency or otherwise compromise the cleaning benefits provided by the detergent composition is not known.

Laundry detergent compositions which further include a fabric softener to provide softening or conditioning of fabrics in the wash cycle of the laundering operation are well-known in the art and described in the patent literature. See, for example, U.S. Pat. No. 4,605,506 to Wixon; U.S. Pat. No. 4,818,421 to Boris et al. and U.S. Pat. No. 4,569, 773 to Ramachandran et al., all assigned to Colgate-Palmolive Co., and U.S. Pat. No. 4,851,138 assigned to Akzo. U.S. Pat. No. 5,972,870 to Anderson describes a multi-layered laundry tablet for washing which may include a detergent in the outer layer and a fabric softener, or water softener or fragrance in the inner layer. But, these type of multi-benefit products suffer from a common drawback, namely, there is an inherent compromise which the user necessarily makes between the cleaning and softening benefits provided by such products as compared to using a separate detergent composition solely for cleaning in the wash cycle and a separate softening composition solely for softening in the rinse cycle. In essence, the user of such detergent softener compositions does not have the ability to independently adjust the amount of detergent and softener added to the wash cycle of a machine in response to the cleaning and softening requirements of the particular wash load.

Some attempts have been made in the art to develop wash cycle active fabric softeners, typically in powder form. But, these type products are characterized by the same inconvenience inherent with the use of powered detergents, namely, problems of handling, caking in the container or wash cycle dispenser, and the need for a dosing device to deliver the desired amount of active softener material to the wash water.

The use of a unit dose fabric softening composition contained in a water soluble container such as a sachet offers numerous advantages. To be effective, the unit dose fabric softening compositions, contained in a sachet, must be able to disperse in the wash liquor in a short period of time to avoid any residue at the end of the wash cycle.

Typically, the wash cycle time can be as short as 12 minutes and as long as 90 minutes (in typical European washers) depending on the type of washer and the wash conditions. Therefore, the water-soluble film of the sachet must be soluble in the wash liquor before the end of the cycle.

SUMMARY OF THE INVENTION

The present invention provides a unit dose fabric softening composition contained in a water soluble container for softening or conditioning fabrics in an automatic washing machine, said unit dose comprising (a) a wash soluble container; and (b) disposed in the water soluble container is a fabric softener composition, the amount of composition being sufficient to form a unit dose capable of providing effective delivery of fragrance to the fabric, antistatic benefits and softening or conditioning of fabrics in said washing machine.

The term "fabric softener" is used herein for purposes of convenience to refer to materials which provide softening and/or conditioning benefits to fabrics in a home or automatic laundering machine as well as effectively delivering antistatic benefits and fragrance to the fabric being cleaned.

The fabric softener composition of the invention is preferably comprised of one or more fabric softening agents and a perfume.

In accordance with the process aspect of the invention there is provided a process for softening or conditioning laundry which comprises contacting the laundry with an effective amount of the unit dose laundry composition defined above.

DETAILED DESCRIPTION OF THE INVENTION

The present invention relates to a water soluble sachet containing a unit dose of a fabric softener composition, wherein the water soluble sachet is formed from a single layer of water soluble thermoplastic film such as a polyvinyl alcohol, wherein the inner surface of the film is in contact with the fabric softener composition and the external surface of the film does not have a water soluble glue disposed thereon.

The fabric softener composition contained in a water soluble container which is formed from a water soluble polymer which is selected from the group consisting of polyvinyl alcohols, polyvinyl alcohol copolymers such as polyvinyl alcohol/polyvinyl pyrrolidone, partially hydrolyzed polyvinyl acetate, polyvinyl pyrrolidone, alkyl celluloses such as methyl cellulose, ethyl cellulose and propyl cellulose, ethers and esters of alkyl celluloses of alkyl celluloses, hydroxy ethyl cellulose, hydroxy propyl cellulose, carboxy methyl cellulose sodium, dextrin, maltodextrin, such as methyl cellulose, ethyl cellulose and propyl cellulose, water soluble polyacrylates, water soluble polyacrylamides and acrylic acid/maleic anhydride copolymers comprises approximately by weight:

(a) 48% to 82% of at least one amine fabric softening active compound;

(b) 0.1% to 18% of an alpha hydroxy aliphatic acid selected from the group consisting of citric acid, lactic acid, glycolic acid and mixtures thereof, wherein the amine fabric softening active compound at least partially reacts in situ with the alpha hydroxy acid to form an amine salt of the alpha hydroxy acid;

(c) 0.5% to 6% of a cationic surfactant;

(d) 1 % to 9% of a cationic softener;

(e) 4% to 14% of a perfume; and (f) less than 6% of water, wherein the composition does not contain an anionic sulfate surfactant, an anionic sulfacte surfactant, a hexeylene glycol or an amine oxide surfactant.

Another fabric softener composition contained in a water sachet comprises approximately by weight:

(a) 50% to 70% of at least one amine fabric softening active compound;

(b) 13% to 23% of an alpha hydroxy acid selected from the group consisting of citric acid and lactic acid and mixtures thereof, wherein the amine fabric softening active compound at least partially reacts in situ with the alpha hydroxy acid to form an amine salt of the alpha hydroxy acid;

(c) 0.5% to 6% of a cationic surfactant;

(d) 3% to 12% of a perfume; and (e) less than 9% of water, wherein the composition does not contain an anionic sulfate surfactant, an anionic sulfonate surfactant, a hexeylene glycol or an amine oxide surfactant.

Another fabric softener composition contained in a water soluble container which is formed from a water soluble polymers are selected from the group consisting of polyvinyl alcohols, polyvinyl alcohol copolymers such as polyvinyl alcohol/polyvinyl pyrrolidone, partially hydrolyzed polyvinyl acetate, polyvinyl pyrrolidone, alkyl celluloses such as methyl cellulose, ethyl cellulose and propyl cellulose, ethers and esters of alkyl celluloses of alkyl celluloses, hydroxy ethyl cellulose, hydroxy propyl cellulose, carboxy methyl cellulose sodium, dextrin, maltodextrin, such as methyl cellulose, ethyl cellulose and propyl cellulose, water soluble polyacrylates, water soluble polyacrylamides and acrylic acid/maleic anhydride copolymers comprises approximately by weight:

(a) 28% to 42% of at least one amine fabric softening active compound;

(b) 5% to 15% of an alpha hydroxy acid selected from the group consisting of citric acid and lactic acid and mixtures thereof, wherein the amine fabric softening active compound at least partially reacts in situ with the alpha hydroxy acid to form an amine salt of the alpha hydroxy acid;

(c) 0.1% to 4% of a cationic surfactant;

(d) 4% to 12% of a perfume;

(e) 25% to 50% of an alkali metal sulfate such as sodium sulfate;

(f) and less than 5% of water, wherein the composition does not contain an anionic sulfate surfactant, an anionic sulfonate surfactant, a hexeylene glycol or an amine oxide surfactant.

The instant compositions do not contain a detergent builder salt, a silicone glycol copolymer, a nonionic surfactant, a green colorant, a yellow colorant or a poly (oxyalkylene) substrated colorant.

As used herein and in the appended claims the term "perfume" is used in its ordinary sense to refer to and include any non-water soluble fragrant substance or mixture of substances including natural (i.e., obtained by extraction of flower, herb, blossom or plant), artificial (i.e., mixture of natural oils or oil constituents) and synthetically produced substance) odoriferous substances. Typically, perfumes are complex mixtures of blends of various organic compounds such as alcohols, aldehydes, ethers, aromatic compounds and varying amounts of essential oils (e.g., terpenes) such as from 0% to 80%, usually from 10% to 70% by weight, the essential oils themselves being volatile odoriferous compounds and also serving to dissolve the other components of the perfume.

In the present invention the precise composition of the perfume is of no particular consequence to softening performance so long as it meets the criteria of water immiscibility and having a pleasing odor. Naturally, of course, especially for softening compositions intended for use in the home, the perfume, as well as all other ingredients, should be cosmetically acceptable, i.e., non-toxic, hypoallergenic, etc.

The fabric softening active compound is an amidoamine of formula (1):

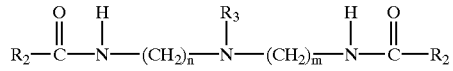

(I)

In the above formula $R_1$ and $R_2$ are each, independently, long chain alkyl or alkenyl groups having from 8 to 22 carbon atoms, preferably from 10 to 18 carbon atoms, such as, for example, octyl, octenyl, decyl, decenyl, dodecyl, dodecenyl, octadecyl, octadecenyl. Typically, $R_1$ and $R_2$, and more generally $R_1$—CO and $R_2$—CO , will be derived from natural oils containing fatty acids or fatty acid mixtures, such as coconut oil, palm oil, tallow, rape oil and fish oil. chemically synthesized fatty acids are also usable. The saturated fatty acids or fatty acid mixtures, and especially hydrogenated tallow (H-tallow) acid (also referred to as hard tallow), are preferred. Generally and preferably $R_1$ and $R_2$ are derived from the same fatty acid or fatty acid mixture.

$R_3$ represents $(CH_2CH_2O)pH$, $CH_3$ or H, or mixtures thereof may also be present. When $R_3$ represents the preferred $(CH_2CH_2O)pH$ group, p is a positive number representing the average degree of ethoxylation, and is preferably from 1 to 10, especially 1.5 to 6, and most preferably from about 2 to 4, such as 2.5 n and m are each integers of from 1 to 5, preferably 2 to 4, especially 2. The compounds of formula (I) in which $R_3$ represents the preferred $(CH_2CH_2O)$ pH group are broadly referred to herein as ethoxylated amidoamines, and the term "hydroxyethyl" is also used to describe the $(CH_2CH_2O)pH$ group.

Especially preferred is the compound of formula (I) which is commercially available is Varisoft™510, available from Sherex Chemical Company, which is bis(hydrogenated tallow-amidoethyl)-hydroxyethyl amine of formula:

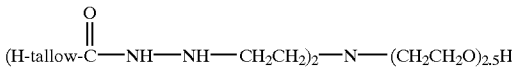

Another especially preferred fabric softening active compound is an amine such as Adogen™343 available from Degussa, Goldschmidt Textile Care which is a bis (hydrogenated tallow)-methyl amine. Another useful amine which is availalbe from BASF Kaosoft PH, Kao Corporation S.A. is di(hydrogenated tallow) diester of methyl diethanol amine.

An especially preferred composition consists of a mixture of Varisoft 510 and Adogen 343 in a weight ratio of 1.5:1 to 1:0.75.

In place of the Varisoft 510, or in combination therewith, the corresponding soft (non-hydrogenated) tallow derivative, available from Sherex as Varisoft 512, may be used. Varisoft 512 is ethoxylated with 3.5 moles, on average, rather than 2.5 moles EO as in Varisoft 510. The softening performance of the hard tallow derivative is somewhat better than that of the soft tallow. It has been found that when Varisoft 510 and Varisoft 512 are used in admixture, preferably at ratios of about 10:1 to about 1.5:1, preferably from 8:1 to 2:1, especially 6:1 to 3:1, both softening performance and stability are improved.

The cationic softener is represented by the following formula:

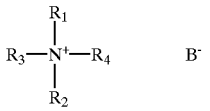

wherein $R_1$ and $R_2$ can independently be a $C_{12}$–$C_{22}$ alkyl or alkenyl group and $R_3$ and $R_4$ are methyl groups and B is an inorganic anion selected from the group consisting of chloride sulfate, hydrogen sulfate, nitrate, phosphate, hydrogen phosphate and dehydrogen phosphate and preferably is chloride. A preferred cationic softener is Arosurf™TA-1 00 available from Degussa, Goldschmidt Textile Care wherein Arosurf™ TA-100 is a dimethyl ammonium chloride.

The cationic surfactant which can be used in the instant composition has the formula (I):

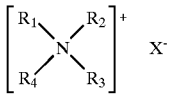

(I)

wherein $R_1$ is an alkyl or alkenyl radical containing from about 8 to about 22 carbon atoms, $R_2$ is an alkyl group of not more than 6 carbon atoms, $R_3$ and $R_4$, which may be the same or different, are selected from the group consisting of alkyl of not more than 6 carbon atoms and $(R_5O)_n$ H, wherein $R_5$ is an alkylene of 2 to 4 carbon atoms and n is a number of from 1 to 25, and X is a water-soluble anion such as chloride or $CH_3SO_4$methyl sulfate. A preferred cationic surfactant is stearyl 15 EO ammonium methyl sulfate available from Adogen 66 is also Degussa, Goldschmidt Textile Care The water soluble container (sachet) which can be in the form of a sachet, a blow molded capsule or other blow molded shapes, an injected molded ampoule or other injection molded shapes, or rotationally molded spheres or capsules are formed from a water soluble thermoplastic resin. The water soluble polymers are selected from the group consisting of polyvinyl alcohols, polyvinyl alcohol copolymers such as polyvinyl alcohol/polyvinyl pyrrolidone, partially hydrolyzed polyvinyl acetate, polyvinyl pyrrolidone, alkyl celluloses such as methyl cellulose, ethyl cellulose and propyl cellulose, ethers and esters of alkyl celluloses of alkyl celluloses, hydroxy ethyl cellulose, hydroxy propyl cellulose, carboxy methyl cellulose sodium, dextrin, maltodextrin, such as methyl cellulose, ethyl cellulose and propyl cellulose, water soluble polyacrylates, water soluble polyacrylamides and acrylic acid/maleic anhydride copolymers. Especially preferred water soluble plastics which may be considered for forming the container include low molecular weight and/or chemically modified polylactides; such polymers have been produced by Chronopol, Inc. and sold under the Heplon trademark. Also included in the water soluble polymer family are melt processable poly(vinyl) alcohol resins (PVA); such resins are produced by Texas Polymer Services, Inc., tradenamed Vinex, and are produced under license from Air Products and Chemicals, Inc. and Monosol film produced by Monosol LLC. Other suitable resins include poly (ethylene oxide) and cellulose derived water soluble carbohydrates. The former are produced by Union Carbide, Inc. and sold under the tradename Polyox; the latter are produced by Dow Chemical, Inc. and sold under the Methocel trademark. Typically, the cellulose derived water soluble polymers are not readily melt processable. The preferred water soluble thermoplastic resin for this application is PVA produced by Monosol LLC. Any number or combination of PVA resins can be used. The preferred grade, considering resin processability, container durability, water solubility characteristics, and commercial viability is Monosol film having a weight average molecular weight range of about 55,000 to 65,000 and a number average molecular weight range of about 27,000 to 33,000.

The sachet may be formed from poly(vinyl) alcohol film. The pelletized, pre-dried, melt processable polyvinyl alcohol (PVA) resin, is feed to a film extruder. The feed material may also contain pre-dried color concentrate which uses a PVA carrier resin. Other additives, similarly prepared, such as antioxidants, UV stabilizers, anti-blocking additives, etc. may also be added to the extruder. The resin and concentrate are melt blended in the extruder. The extruder die may consist of a circular die for producing blown film or a coat hanger die for producing cast film. Circular dies may have rotating die lips and/or mandrels to modify visual appearance and/or properties. Alternatively, the PVA resins can also be dissolved and formed into film through a solution-casting process, wherein the PVA resin or resins are dissolved and mixed in an aqueous solution along with additives. This solution is cast through a coat hanger die, or in front of a doctor blade or through a casting box to produce a layer of solution of consistent thickness. This layer of solution is cast or coated onto a drum or casting band or appropriate substrate to convey it through an oven or series of ovens to reduce the moisture content to an appropriate level. The extruded or cast film is slit to the appropriate width and wound on cores. Each core holds one reel of film.

Typical film properties are:

1. Tensile strength (125 mil, break, 50% RH)=4,700 to 5,700 psi
2. Tensile modulus (125 mil, 50% RH)=47,000 to 243,000 psi; preferred range is 140,000 to 150,000 psi
3. Tear resistance (mean) (ASTM-D-199 gm/ml)= 900–1500
4. Impact strength (mean) (ASTM-D-1 709, gm)=600–1, 000
5. 100% Elongation (mean) (ASTM-D-882, psi)= 300–600
6. Oygen transmission (1.5 mil, 0% RH, 1 atm)=0.0350 to 0.450 cc/100 sq. in./24 h
7. Oxygen transmission (1.5 mil, 50% RH, 1 atm)=1.20 to 1.50 cc/100 sq. in./24 h
8. 100% modulus (mean) (ASTM-D-882, psi)= 1000–3000
9. Solubility (sec) (MSTM-205,75° F.) disintegration= 1–15; dissolution=10–30

Typical resin properties are:

1. Glass Transition Temperature (° C.)=28 to 38; preferred is 28 to 33,

2. Weight Average Molecular Weight (Mw)=15,000 to 95,000; preferred is 55,000–65,000
3. Number Average Molecular Weight (Mn)=7,500 to 60,000; preferred is 27,000 to 33,000. Preferred poly (vinyl) alcohol film is formed from Monosol 7030 or Monosol 8630

Reels of slit film are fed to a form, fill, seal machine (FFS). The Form, Fill, Seal machine (FFS) makes the appropriate sachet shape (cylinder, square, pillow, oval, etc.) from the film, fills the sachet with product, and seals the sachet.

There are many types of form fill seal machines that can convert water soluble films, including vertical, horizontal and rotary machines. To make the appropriate sachet shape, one or multiple films can be used. The sachet shape can be folded into the film, mechanically deformed into the film, or thermally deformed into the film. The sachet forming can also utilize thermal bonding of multiple layers of film, or solvent bonding of multiple layers of film. When using poly(vinyl) alcohol the most common solvent is water. Once the appropriately shaped sachet is filled with product, the sachet can be sealed using either thermal bonding of the film, or solvent bonding of the film.

Blow molded capsules are formed from the poly(vinyl) alcohol resin having a molecular weight of about 50,000 to about 70,000 and a glass transition temperature of about 28 to 33° C. Pelletized resin and concentrate(s) are feed into an extruder. The extruder into which they are fed has a circular, oval, square or rectangular die and an appropriate mandrel. The molten polymer mass exits the die and assumes the shape of the die/mandrel combination. Air is blown into the interior volume of the extrudate (parison) while the extrudate contacts a pair of split molds. The molds control the final shape of the package. While in the mold, the package is filled with the appropriate volume of liquid. The mold quenches the plastic. The liquid is contained within the interior volume of the blow molded package.

An injection molded ampoule or capsule is formed from the poly(vinyl) alcohol resin having a molecular weight of about 50,000 to about 70,000 and a glass transition temperature of about 28 to 38° C. Pelletized resin and concentrate(s) are fed to the throat of an reciprocating screw, injection molding machine. The rotation of the screw pushes the pelletized mass forward while the increasing diameter of the screw compresses the pellets and forces them to contact the machine's heated barrel. The combination of heat, conducted to the pellets by the barrel and frictional heat, generated by the contact of the pellets with the rotating screw, melts the pellets as they are pushed forward. The molten polymer mass collects in front of the screw as the screw rotates and begins to retract to the rear of the machine. At the appropriate time, the screw moves forward forcing the melt through the nozzle at the tip of the machine and into a mold or hot runner system which feeds several molds. The molds control the shape of the finished package. The package may be filled with liquid either while in the mold or after ejection from the mold. The filling port of the package is heat sealed after filling is completed. This process may be conducted either in-line or off-line.

A rotationally molded sphere or capsule is formed from the poly(vinyl) alcohol resin having a molecular weight of about 50,000 to about 70,000 and a glass transition temperature of about 28 to 38° C. Pelletized resin and concentrate are pulverized to an appropriate mesh size, typically 35 mesh. A specific weight of the pulverized resin is fed to a cold mold having the desired shape and volume. The mold is sealed and heated while simultaneously rotating in three directions. The powder melts and coats the entire inside surface of the mold. While continuously rotating, the mold is cooled so that the resin solidifies into a shape which replicates the size and texture of the mold. After rejection of the finished package, the liquid is injected into the hollow package using a heated needle or probe after filling, the injection port of the package is heat sealed.

Typical unit dose compositions for use herein may vary from about 5 to about 20 ml corresponding on a weight basis to about 5 to about 20 grams (which includes the weight of the capsule).

The following examples illustrate liquid fabric softening compositions of the described invention. Unless otherwise specified, the proportions in the film and elsewhere in the specification are by weight.

EXAMPLE 1

The following fabric softener to be used in the wash cycle was prepared comprising the following ingredients

| | Wt. % |
|---|---|
| Varisoft 510 | 40.3 |
| Adogen 343 | 26.9 |
| Glycolic acid | 7.9 |
| Citric acid | 4.6 |
| Adogen 66 | 2.1 |
| Arosurt TA-100 | 5.4 |
| Blue Diamond II perfume | 8.6 |
| Water | 4.2 |

The formulation above was the result of evaluation of the individual amines and a range of mixtures. Single acid systems and mixed acid systems were also evaluated. The least water dispersible formulations contained exclusively Adogen 343 and citric acid. These systems delivered the best antistat benefits. The most water dispersible systems contained exclusively Varisoft 510 and glycolic acid. These systems delivered the least effective antistat. Formulation optimization depended on the size, shape and thickness of the soft solid dose chosen. Scale up to production could be executed best by vertical filing (with melted product) of rectangular PVA pouches and letting the pouch lay flat while the product solidifies. The formulation above was evaluated in this form in pouches 6.5 cm by 7 cm and showed effective fragrance delivery, good antistatic benefits, good fabric softening and residue between 1–2%.

The formulation shown above was evaluated in the form of a flat 2–3 mm thick 6 gram cylinder sealed into a polyvinyl alcohol (PVA) water soluble pouch. Two 6 grams doses are used per 6.5 pound fabric load. In washes with 85 grams Liquid Tide as the detergent the following profile was observed:

| Temperature | Static | Residue |
|---|---|---|
| 90° F. | very light to light | none |
| 70° F. | none | none |
| 50° F. | none | 2.2% |

In washes with 125 grams Powdered Tide as the detergent the following profile was observed:

| Temperature | Static | Residue |
|---|---|---|
| 90° F. | very light | none |
| 70° F. | none | none |
| 50° F. | none | 5.1% |

The residue profile is good but at the most desirable level of none at all wash temperatures. There is sufficient residue at 50° F. that we would expect occasional spotting in the dryer. A fabric softening panel with treated towels showed softening equal to 30 grams per wash clay/PDT fabric softening system for both towels washed in Liquid Tide and towels washed in powdered Tide. Fragrance delivery results were 31% of rinse cycle for washes in Liquid Tide and 32% of rinse cycle for washes in powdered Tide average of multiple analysis.

EXAMPLE 2

The following fabric softener composition formula to be used in the rinse cycle was prepared in wt. % by simple mixing:

| | Wt. % |
|---|---|
| Adogen 343 | 64.3 |
| Citric acid | 17.6 |
| Adogen 66 | 3.5 |
| Perfume | 6.8 |
| Water | 7.7 |

Two rough particle size fractions were prepared. The first fraction comprised the material passed through a 10 mesh sieve (1700 micrometers) and did not pass through a 20 mesh sieve (850 micrometers). The second fraction comprised the material passed through the 20 mesh sieve.

The larger particles were needed to provide effective antistatic benefits at the lowest use level with clay/PDT. The smaller particles were too dispersible to deliver antistat. Effective antistat can be achieved at 3 grams on 20 mesh powder per wash (1.5 grams per pouch).

In washes with 85 grams Liquid Tide as the detergent the following profile was observed:

| Temperature | Static | Residue |
|---|---|---|
| 90° F. | none | none |
| 70° F. | none | some fine powder |
| 50° F. | none | 13.4% |

As when Adogen 343—citric acid complex was used as cylinders there was residue at 50° F. The 13.4% residue amounts to 0.402 grams of small particles. This level of residue will not cause Quat staining in the drier. The soft solid studies showed that 0.12 grams remaining did not cause Quat staining with much larger particles.

Additional formula modifications will be made to try to improve cold water dispersion while not loosing effective antistat at 90° F. Any amine acid complex powder will need to be coated to provide particle integrity during aging at 45° C. The amine acid complex powder was effectively coated in a mini fluid bed system with polyethylene glycol of 8500 molecular weight, which has a melting point of 85° C. A modified powder was prepared to improve the ability to grind the soft amine citrate into a powder form. Solid sodium sulfate was added to the amine acid complex melt and mixed until uniform. Then the system was cooled until solid.

EXAMPLE 3

The following fabric softener composition formulas to be used in the rinse cycle was prepared in wt. % by simple mixing:

| | Wt. % |
|---|---|
| Adogen 343 | 38.6 |
| Citric acid | 10.6 |
| Adogen 66 | 2.0 |
| Perfume | 7.8 |
| Water | 2.7 |
| Sodium sulfate | 38.7 |

In washes with 85 grams Liquid Tide as the detergent the following profile was observed:

| Temperature | Static | Residue |
|---|---|---|
| 90° F. | light | 1.6% |
| 70° F. | very light | 1.3% |
| 50° F. | none | 1.2% |

The system with sodium sulfate used at 6 grams per wash (3 grams per pouch). Used as a through 10 mesh on 20 mesh particle size the formulation delivered excellent antistat and residue in gram always less than 0.1 grams. This system would not be expected to cause fabric staining. Interestingly the system with sodium sulfate used as a through 20 mesh powder 6 grams per wash delivered complete static reduction and also little residue.

In washes with 85 grams Liquid Tide as the detergent the following profile was observed:

| Temperature | Static | Residue |
|---|---|---|
| 90° F. | none | none |
| 70° F. | none | 0.3% |
| 50° F. | none | 1.8% |

The following fabric softener composition formulas to be used in the rinse cycle was prepared in wt. % by simple mixing:

| | Wt. % |
|---|---|
| Varisoft 510 | 39.2 |
| Sulfuric acid | 1.2 |
| Citric acid | 7.4 |
| Adogen 66 | 2.0 |
| Perfume | 7.8 |
| Water | 3.2 |
| Sodium sulfate | 39.2 |

In washes with 85 grams Liquid Tide as the detergent the following profile was observed:

| | grams/wash example 4 | | 9 grams/wash example 4 | |
|---|---|---|---|---|
| Temperature | Static | Residue | Static | Residue |
| 90° F. | light | none | very light | none |
| 70° F. | light | none | very light | none |
| 50° F. | light | none | very light | none |

The following fabric softener composition formulas to be used in the rinse cycle was prepared in wt. % by simple mixing:

| | Wt. % |
|---|---|
| Adogen 343 | 34.8 |
| Stearic acid | 3.5 |
| Citric acid | 9.4 |
| Adogen 66 | 8.0 |
| Perfume | 7.0 |
| Water | 2.5 |
| Sodium sulfate | 34.8 |

In washes with 85 grams liquid tide as the detergent the following profile was observed:

| | 12 grams/wash example 5 | |
|---|---|---|
| Temperature | Static | Residue |
| 90° F. | very light | none |
| 70° F. | very light | none |
| 50° F. | very light | none |

What is claimed is:

1. A softening system which comprises:

(a) a water soluble container which is formed from a water soluble polymer which is selected from the group consisting of polyvinyl alcohols, polyvinyl alcohol copolymers such as polyvinyl alcohol/polyvinyl pyrrolidone, partially hydrolyzed polyvinyl acetate, polyvinyl pyrrolidone, alkyl celluloses such as methyl cellulose, ethyl cellulose and propyl cellulose, ethers and esters of alkyl celluloses of alkyl celluloses, hydroxy ethyl cellulose, hydroxy propyl cellulose, carboxy methyl cellulose sodium, dextrin, maltodextrin, such as methyl cellulose, ethyl cellulose and propyl cellulose, water soluble polyacrylates, water soluble polyacrylamides and acrylic acid/maleic anhydride copolymers;

(b) a fabric softener composition comprising approximately:

(i) 48% to 82% of at least one amine fabric softening active compound which is selected from the group consisting of di(hydrogenated tallow) diester of methyl diethanol amine and bis(hydrogenated tallow)-methyl amine and mixtures thereof;

(ii) 0.1% to 18% of an alpha hydroxy aliphatic acid selected from the group consisting of citric acid, lactic acid and glycolic acid and mixtures thereof;

(iii) 0.5% to 6% of a cationic surfactant;

(iv) 1 % to 9% of a cationic softener;

(v) 4% to 14% of a perfume; and (vi) less than 6% of water wherein the composition do not contain an anionic sulfate surfactant, sulfonate surfactants, a hexylene glycol, amine oxide or a detergent builder salt.

2. The system according to claim 1 wherein said container is formed from a water soluble, melt processable polymer.

3. The system according to claim 1 wherein said container is formed from a polyvinyl alcohol polymer or a polyvinyl alcohol copolymer.

4. The system according to claim 2 wherein said container is a sachet, ampoule, capsule or sphere.

5. A softening system which comprises:

(a) a water soluble container which is formed from a water soluble polymers are selected from the group consisting of polyvinyl alcohols, polyvinyl alcohol copolymers such as polyvinyl alcohol/polyvinyl pyrrolidone, partially hydrolyzed polyvinyl acetate, polyvinyl pyrrolidone, alkyl celluloses such as methyl cellulose, ethyl cellulose and propyl cellulose, ethers and esters of alkyl celluloses of alkyl celluloses, hydroxy ethyl cellulose, hydroxy propyl cellulose, carboxy methyl cellulose sodium, dextrin, maltodextrin, such as methyl cellulose, ethyl cellulose and propyl cellulose, water soluble polyacrylates, water soluble polyacrylamides and acrylic acid/maleic anhydride copolymers;

(b) a liquid fabric softener composition disposed in said water soluble container, wherein said fabric softener composition comprises approximately by weight:

(i) 50% to 70% of at least one amine fabric softening active compound which is selected from the group consisting of di(hydrogenated tallow) diester of methyl diethanol amine and bis(hydrogenated tallow)-methyl amine and mixtures thereof;

(ii) 13% to 23% of an alpha hydroxy aliphatic acid selected from the group consisting of citric acid and lactic acid and mixtures thereof;

(iii) 0.5% to 6% of a cationic surfactant;

(iv) 3% to 12% of a perfume; and (v) less than 9% of water wherein the composition do not contain an anionic sulfate surfactant, sulfonate surfactants, a hexylene glycol, amine oxide or a detergent builder salt.

6. The system according to claim 5 wherein said container is formed from a water soluble, melt processable polymer.

7. The system according to claim 5 wherein said container is formed from a polyvinyl alcohol polymer or a polyvinyl alcohol polymer.

8. The system according to claim 6 wherein said container is a sachet, ampoule, capsule or sphere.

9. A softening system which comprises:

(a) a water soluble container which is formed from a water soluble polymers are selected from the group consisting of polyvinyl alcohols, polyvinyl alcohol copolymers such as polyvinyl alcohol/polyvinyl pyrrolidone, partially hydrolyzed polyvinyl acetate, polyvinyl pyrrolidone, alkyl celluloses such as methyl cellulose, ethyl cellulose and propyl cellulose, ethers and esters of alkyl celluloses of alkyl celluloses, hydroxy ethyl cellulose, hydroxy propyl cellulose, carboxy methyl cellulose sodium, dextrin, maltodextrin, such as methyl cellulose, ethyl cellulose and propyl cellulose, water soluble polyacrylates, water soluble polyacrylamides and acrylic acid/maleic anhydride copolymers;

(b) a fabric softener composition disposed in said water soluble container, wherein said fabric softener composition comprises approximately by weight:

(i) 28% to 42% of at least one amine fabric softening active agent which is selected from the group consisting of di(hydrogenated tallow) diester of methyl diethanol amine and bis(hydrogenated tallow)-methyl amine and mixtures thereof;

(ii) 5% to 15% of an alpha hydroxy aliphatic acid selected from the group consisting of citric acid, lactic acid and glycolic acid and mixtures thereof;

(iii) 0.1% to 4% of a cationic surfactant;

(iv) 4% to 12% of a perfume;

(v) 25% to 50% of an alkali metal sulfate such as sodium sulfate;

(vi) less than 5% of water wherein the composition do not contain an anionic sulfate surfactant, sulfonate surfactants, a hexylene glycol, amine oxide or a detergent builder salt.

10. A softening system which comprises:

(a) a water soluble container which is formed from a water soluble polymers are selected from the group consisting of polyvinyl alcohols, polyvinyl alcohol copolymers such as polyvinyl alcohol/polyvinyl pyrrolidone, partially hydrolyzed polyvinyl acetate, polyvinyl pyrrolidone, alkyl celluloses such as methyl cellulose, ethyl cellulose and propyl cellulose, ethers and esters of alkyl celluloses of alkyl celluloses, hydroxy ethyl cellulose, hydroxy propyl cellulose, carboxy methyl cellulose sodium, dextrin, maltodextrin, such as methyl cellulose, ethyl cellulose and propyl cellulose, water soluble polyacrylates, water soluble polyacrylamides and acrylic acid/maleic anhydride copolymers;

(b) a fabric softener composition disposed in said water soluble container, wherein said fabric softener composition comprises approximately by weight:

(i) 28% to 42% of at least one amine fabric softening active agent which is selected from the group consisting of di(hydrogenated tallow) diester of methyl diethanol amine and bis(hydrogenated tallow)-methyl amine and mixtures thereof;

(ii) 5% to 15% of an alpha hydroxy aliphatic acid selected from the group consisting of citric acid, lactic acid and glycolic acid and mixtures thereof;

(iii) 0.1% to 4% of a cationic surfactant;

(iv) 4% to 12% of a perfume;

(v) 25% to 50% of an alkali metal sulfate such as sodium sulfate;

(vi) 0.1% to 1% of a mineral acid selected from the group consisting of sulfuric acid and hydrochloric acid;

(vii) less than 5% of water wherein the composition do not contain an anionic sulfate surfactant, sulfonate surfactants, a hexylene glycol, amine oxide or a detergent builder salt.

11. A softening system which comprises:

(a) a water soluble container which is formed from a water soluble polymers are selected from the group consisting of polyvinyl alcohols, polyvinyl alcohol copolymers such as polyvinyl alcohol/polyvinyl pyrrolidone, partially hydrolyzed polyvinyl acetate, polyvinyl pyrrolidone, alkyl celluloses such as methyl cellulose, ethyl cellulose and propyl cellulose, ethers and esters of alkyl celluloses of alkyl celluloses, hydroxy ethyl cellulose, hydroxy propyl cellulose, carboxy methyl cellulose sodium, dextrin, maltodextrin, such as methyl cellulose, ethyl cellulose and propyl cellulose, water soluble polyacrylates, water soluble polyacrylamides and acrylic acid/maleic anhydride copolymers;

(b) a fabric softener composition disposed in said water soluble container, wherein said fabric softener composition comprises approximately by weight:

(i) 28% to 42% of at least one amine fabric softening active agent which is selected from the group consisting of di(hydrogenated tallow) diester of methyl diethanol amine and bis(hydrogenated tallow)-methyl amine and mixtures thereof;

(ii) 5% to 15% of an alpha hydroxy aliphatic acid selected from the group consisting of citric acid, lactic acid and glycolic acid and mixtures thereof;

(iii) 0.1% to 10% of a cationic surfactant;

(iv) 0.1% to 8% of a fatty acid selected from the group consisting of stearic acid, palmitic acid, myristic acid;

(v) 4% to 12% of a perfume;

(vi) 25% to 50% of an alkali metal sulfate such as sodium sulfate;

(vii) less than 5% of water wherein the composition do not contain an anionic sulfate surfactant, sulfonate surfactants, a hexylene glycol, amine oxide or a detergent builder salt.

12. The system according to claim 9 wherein said container is formed from a water soluble, melt processable polymer.

13. The system according to claim 9 wherein said container is formed from a polyvinyl alcohol polymer or a polyvinyl alcohol copolymer.

14. The system according to claim 10 wherein said container is a sachet, ampoule, capsule or sphere.

* * * * *